US005297926A

United States Patent [19]

Negishi

[11] Patent Number: 5,297,926

[45] Date of Patent: Mar. 29, 1994

[54] FLOW GENERATING APPARATUS AND METHOD OF MANUFACTURING THE APPARATUS

[75] Inventor: Masataka Negishi, Urawa, Japan

[73] Assignee: Nissho Giken Kabushiki Kaisha, Saitama, Japan

[21] Appl. No.: 772,371

[22] PCT Filed: Mar. 2, 1991

[86] PCT No.: PCT/JP91/00281

§ 371 Date: Nov. 1, 1991

§ 102(e) Date: Nov. 1, 1991

[87] PCT Pub. No.: WO91/13257

PCT Pub. Date: Sep. 5, 1991

[30] Foreign Application Priority Data

Mar. 2, 1990 [JP] Japan ..... 2-49468

[51] Int. Cl.[5] ..... F01D 1/36

[52] U.S. Cl. ..... 415/90; 415/53.2; 415/198.1; 415/206; 416/198 R; 416/204 R; 416/223 B

[58] Field of Search ..... 415/53.1, 53.2, 90, 415/186, 187, 188, 198.1, 203, 206, 208.2, 209.1; 416/198 R, 204 R, 223 B; 29/889, 889.22, 889.4, 889.21

[56] References Cited

U.S. PATENT DOCUMENTS

| | | | |
|---|---|---|---|
| 1,793,179 | 2/1931 | Lanterman et al. | 415/90 |
| 2,087,834 | 7/1937 | Brown et al. . | |
| 2,321,907 | 6/1943 | Gent | 415/90 |
| 2,632,598 | 3/1953 | Wales, Jr. . | |
| 3,017,848 | 1/1962 | Bishop | 415/90 |
| 3,226,012 | 12/1965 | Trask | 415/90 |
| 3,275,223 | 9/1966 | Fowell | 415/53.1 |
| 3,487,784 | 1/1970 | Rafferty et al. . | |
| 4,218,177 | 8/1980 | Robel | 415/90 |
| 4,255,081 | 3/1981 | Oklejas et al. | 415/90 |

FOREIGN PATENT DOCUMENTS

| | | | |
|---|---|---|---|
| 2292882 | 7/1976 | France | 415/206 |
| 0003110 | 1/1975 | Japan . | |
| 0040282 | 11/1976 | Japan . | |
| 0013921 | 4/1978 | Japan . | |
| 0079805 | 6/1979 | Japan . | |
| 0973939 | 11/1982 | U.S.S.R. | 415/90 |
| 0000045 | of 1912 | United Kingdom | 415/90 |
| 2003983 | 3/1979 | United Kingdom . | |
| 2126653 | 3/1984 | United Kingdom | 415/90 |

*Primary Examiner*—Edward K. Look
*Assistant Examiner*—Christopher Verdier
*Attorney, Agent, or Firm*—Wenderoth, Lind & Ponack

[57] ABSTRACT

Movement of a fluid such as air is produced by rotating about a rotational axis a plurality of flow generating plates arranged in parallel with clearances therebetween. The clearances between adjacent flow generating plates for producing the movement of the fluid most effectively only by an adhesion of the fluid to the flow generating plates are set to be twice a value of a distance of an intermediate portion between the surface of the flow generating plate contacting a portion of the fluid in a close boundary layer which is rotated and moved substantially together with the flow generating plate and a remote fluid boundary layer which is substantially not influenced by centrifugal force due to the rotation of the flow generating plate. In the case of air, the clearances are about 0.5 mm. It is preferred to form the flow generating plate so as to have a waved surface for improving the flow generating efficiency.

13 Claims, 11 Drawing Sheets

FLOW GENERATING APPARATUS AND METHOD OF MANUFACTURING THE APPARATUS

BACKGROUND OF THE INVENTION

The present invention relates to a flow generating apparatus such as an air blower or pump for supplying fluid and also relates to a method of manufacturing the apparatus.

There is known a disc type flow generating apparatus in which a plurality of annular flow generating plates are arranged in directions perpendicular to a rotational axis thereof and adapted to be rotated about the rotational axis, and in which fluid is fed due to a frictional force caused between surfaces of these flow generating plates and the fluid, as disclosed in Japanese Patent Publication No. 58-17359 (17359/1983), for example.

The flow generating apparatus of this known type has a simple structure, thus being advantageous in its manufacturing cost, but involves a problem of inadequate performance with respect to the flow rate.

An induction motor has been usually utilized for driving a flow generating apparatus. Since the maximum rotational speed of the induction motor is generally determined on the basis of the power source frequency, a maximum value of the rotational speed of the flow generating apparatus is limited. Such limitation of the rotational speed also depends upon the durability of the shaft bearings used, for example. Such limitation of the maximum rotational speed necessitates an improvement of a space efficiency of the flow generating apparatus, i.e. increasing the flow rate with the same size of the apparatus, instead of increasing the rotational speed in a case where a greater flow rate is needed.

SUMMARY OF THE INVENTION

An object of the present invention is to increase the performance of such flow generating apparatus to an extreme limit. Another object of the present invention is to provide a method of manufacturing a flow generating apparatus having such increased performance.

The flow generating apparatus according to the present invention is characterized by comprising a plurality of flow generating plates arranged with clearances therebetween perpendicularly to a rotational axis thereof, and means for rotating the flow generating plates about the rotational axis, wherein each of the flow generating plates is provided with a surface for moving a fluid only by an adhesion phenomenon between the surface and the fluid in contact with the surface, the surface extends radially of the flow generating plate to an outer peripheral edge thereof from which the fluid moved by the adhesion phenomenon along the surface is finally separated, and the clearances between adjacent flow generating plates are set to be twice an intermediate value of a distance between a surface of the flow generating plate contacting a close fluid boundary layer which has a strong adhesion to said surface and hence is moved substantially together with the flow generating plate and a remote fluid boundary layer which has a weak adhesion to said surface so as not to be subjected to an effect of centrifugal force due to the rotation of the flow generating plate, whereby, the centrifugal force is most effectively exerted on the fluid.

Further, according to the present invention, there is provided a method of manufacturing a flow generating apparatus provided with a plurality of flow generating plates arranged with clearances therebetween perpendicularly to a rotational axis thereof, and means for rotating the flow generating plates about the rotational axis, the method being characterized in that the flow generating plates are assembled such that a distance is determined from a surface of the flow generating plate to a boundary layer of a fluid which has a weak adhesion to the plates and is substantially not influenced by centrifugal force caused by the rotation of the flow generating plate, and each of said clearances between adjacent two flow generating plates is set to be twice an intermediate value of the aforementioned distance from the surface of the flow generating plate to the fluid boundary layer.

According to the flow generating apparatus, when the flow generating plate is driven and rotated, the close fluid boundary layer contacting the surface of the flow generating plate is rotated together with the flow generating plate due to the strong adhesion of the fluid to the flow generating plate, and the fluid in that layer is moved radially outwardly by a combined force of the adhesion force and the centrifugal force caused by the rotation thereof. Further, the fluid in the vicinity of the fluid in the close boundary layer is also moved radially outwardly with a small time delay due to the shearing stresses caused by the movement of the fluid in the boundary layer, and accordingly, this delay in movement is made large in accordance with a distance from the close fluid boundary layer. By setting the clearance between adjacent two flow generating plates so that such a large delay in movement does not exist, the performance such as the rate of flow of the fluid can be extremely improved.

In the fluid boundary layer influenced by the adhesion to the flow generating plate, the centrifugal force is exerted in accordance with the rotation of the flow generating plate due to the adhesion phenomenon to the flow generating plate. The centrifugal force becomes small as the distance from the surface of the flow generating plate becomes large, and the centrifugal force is maximum in a region near the surface of the flow generating plate. The flow generating function is hence produced by a combination of the centrifugal force and the adhesion force. That is, in the region near the surface of the flow generating plate, not only the centrifugal force but also the adhesion force are made large.

It is considered that the adhesion force becomes indefinitely large in the region adjacent to the surface of the flow generating plate, and accordingly, the centrifugal force is suppressed in a region adjacent to the surface of the flow generating plate. Actually, on the surface of the flow generating plate, the fluid adheres thereto, while in a remote region spaced from the surface of the flow generating plate, the adhesion force is weak and, hence, the centrifugal force becomes also small and thus it is difficult to produce a fluid flow. Accordingly, it is concluded that there must exist a range, between the surface portion of the flow generating plate and the region spaced therefrom, in which a proper adhesion force exists and, hence, proper centrifugal force is produced. Accordingly, the present invention was made to improve the performance such as the flow rate of the fluid of the flow generating apparatus by effectively utilizing such an intermediate range between the surface of the flow generating plate and the remote region.

BEST MODE FOR CARRYING OUT THE INVENTION

Before a detailed description of embodiments according to the present invention is made basic principles of the present invention will first be described.

Figure 1:
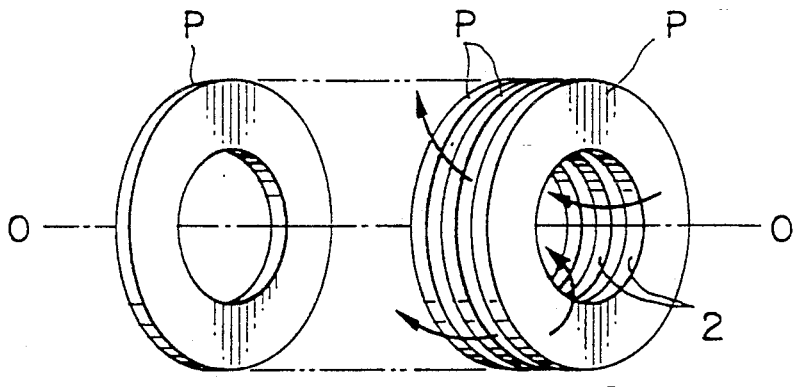
FIG. 1 is a perspective view of the basic structure of a flow generating apparatus according to the present invention.
Figure 2:
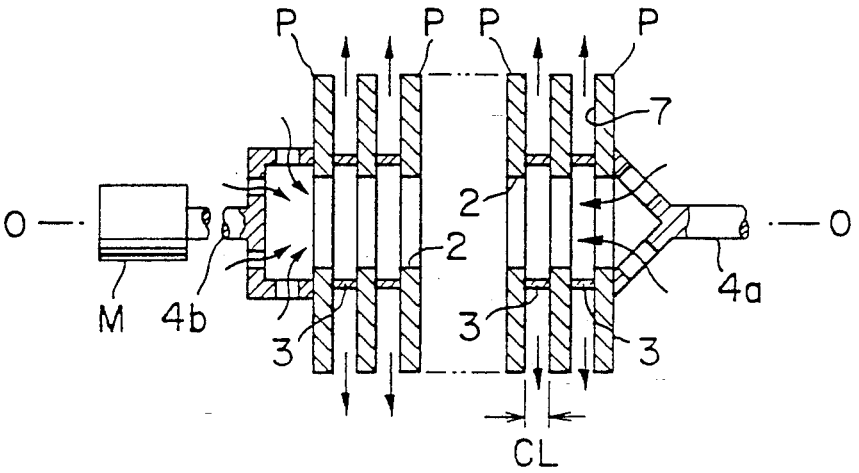
FIG. 2 is an axial sectional view of the flow generating apparatus.
Figure 3:
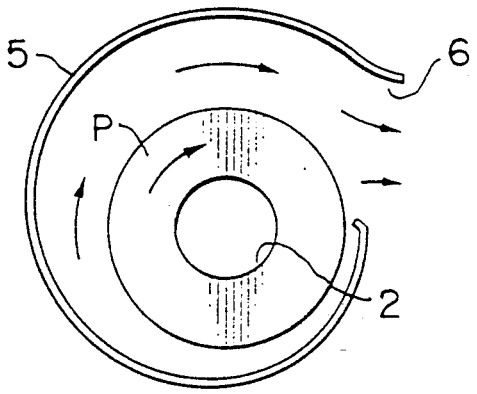
FIG. 3 is a sectional view of the flow generating apparatus taken along a plane perpendicular to the rotational axis thereof.

Referring to FIGS. 1 and 2, a plurality of flow generating plates P each of annular disc shape are integrally arranged perpendicularly to a rotational axis O—O of a flow generating apparatus. The flow generating plates P are arranged in parallel with each other with a clearance CL between adjacent plates and are provided with central circular openings 2. Spacers 3 are provided for maintaining the clearances CL. As shown in FIG. 2, rotating shafts 4*a* and 4*b* are fixed to flow generating plates P disposed at both end positions of the plate arrangement to allow the flow generating plates P to rotate, and an electric motor M is connected to one 4*b* of the rotating shafts. These rotating shafts 4*a* and 4*b* are supported by bearings, not shown. As shown in FIG. 3, the flow generating plates P may be disposed in a casing 5 provided with a delivery opening 6. Further, it is possible to eliminate the other one 4*a* of the rotating shafts and the bearing therefor.

When these flow generating plates P are rotated around the rotational axis O—O, with surfaces 7 of the flow generating plates P (FIG. 2) in contact with a fluid such as air, the fluid in the clearances CL will be fed with components directed radially outwardly of the flow generating plates P as shown by arrows, and accordingly, fluid is sucked in the direction of the axis O—O through the openings 2. One example of the flow generating apparatus operated on such principle is disclosed in Japanese Patent Publication No. 58-17359 (17359/1983).

Figure 4:
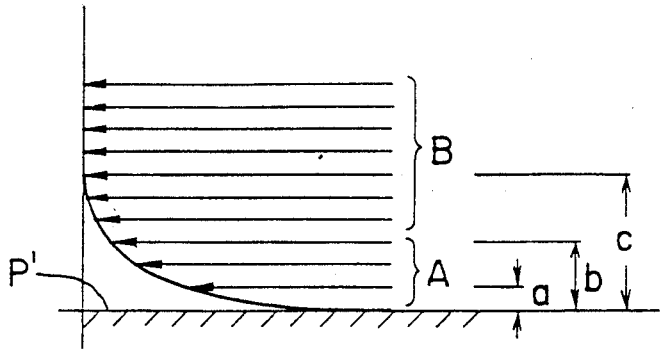
FIG. 4 is an explanatory diagram of boundary layers.

The reason why the air is fed along the surfaces 7 of the flow generating plates P is that a fluid contacting a surface of a solid body adheres to the solid body and the fluid is moved by a combined force of a centrifugal force generated by the rotation of the solid body and of the adhesion force. FIG. 4 is an illustration explanatory of the adhering phenomenon. Referring to FIG. 4, it is assumed that a fluid adjacent to the surface of a solid body P' is flowing leftward as viewed. In such a case, molecules of the fluid near the surface of the solid body P' will be strongly subjected to the effect of the adhering force of the solid body P' and hence the flow speed thereof will be reduced. This phenomenon is explained on the basis of shearing stresses. In FIG. 4, flow speeds of the fluid are expressed by the lengths of the arrows. The molecules of the fluid in direct contact with the surface of the solid body P' do not move due to the adhesion thereto. The fluid portion positioned extremely near the solid body P' shown as a thin boundary layer area A is strongly influenced by the solid body P' due to the function of the shearing stresses occurring due to viscosity of the fluid. The fluid portion positioned in an area B outside the boundary layer area A is continuously and slightly subjected to the shearing stresses, but is substantially not subjected to the effect of the solid body P'. This phenomenon occurs regardless of the material of the surface of the solid body P'. The above relationship of the relative speeds is present in a case where the fluid is stationary and the solid body is moving. In a case of a flat disc plate rotating in the air, the thickness of the boundary layer area largely effected by the centrifugal force generated by the rotation is considerably smaller than 1 millimeter as will be described hereinafter.

Figure 5:
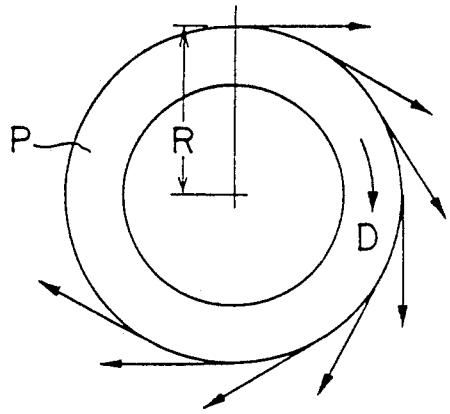
FIG. 5 is an explanatory diagram of a phenomenon occurring during rotation of a flow generating plate.

When the flow generating plate P is rotated in a direction shown by an arrow D in FIG. 5, air flow generated along only one side surface of the flow generating plate P is delivered in directions tangential to the outer peripheral edge of the flow generating plate P. The flow rate Q is expressed as follows.

$$Q=k\cdot R\cdot N$$

wherein letter R represents the radius of the outer peripheral edge of the flow generating plate P, N the rotational speed or the number of rotation, and k a constant. As represented by this equation, the flow rate is in proportion to the radius and the rotational speed, i.e. the peripheral speed of the flow generating plate.

It will be understood that with respect to the fluid flow on one surface of the flow generating plate, the flow rate can be increased only by increasing the constant k if the radius and the rotational speed of the flow generating plate are predetermined. Apart from an increase in the constant k, which will be described hereinafter, an improvement of the performance of the flow generating apparatus with the radius and the axial length of the flow generating apparatus being within prescribed ranges cannot be attained except for an improvement of the space efficiency within the prescribed ranges thereof. Accordingly, the main object of the present invention resides in an improvement of the space efficiency.

It is desirable that the flow generating plates, which are to be accommodated within a predetermined axial length, have a thickness as small as possible because only the surfaces of the flow generating plates affect the flow of fluid and the thickness of the flow generating plates does not contribute at all to the flow of fluid. Accordingly, it is only required that each flow generating plate have a thickness capable of maintaining a required mechanical strength against tensile stresses and centrifugal forces generated within the plane of the flow generating plate mainly at mounting parts thereof. Other forces such as twisting and bending forces are not exerted on the flow generating plate. Accordingly, such mechanical strength can be sufficiently achieved by forming the flow generating plates of a plastic material such as polyethylene terephthalate (PET).

The fact that the flow generating plate can be made definitively thin means that the space efficiency with respect to the flow rate in relation to the rotational axis direction, i.e. the thickness direction of the flow generating plates, is determined only by the dimension of a clearance between the adjacent flow generating plates.

Figure 6A:
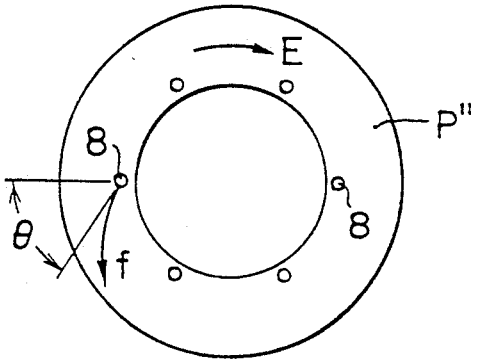
FIGS. 6*a* and 6*b* are a plan view and a sectional view of a flow generating plate utilized for a basic experiment for the present invention.
Figure 6B:
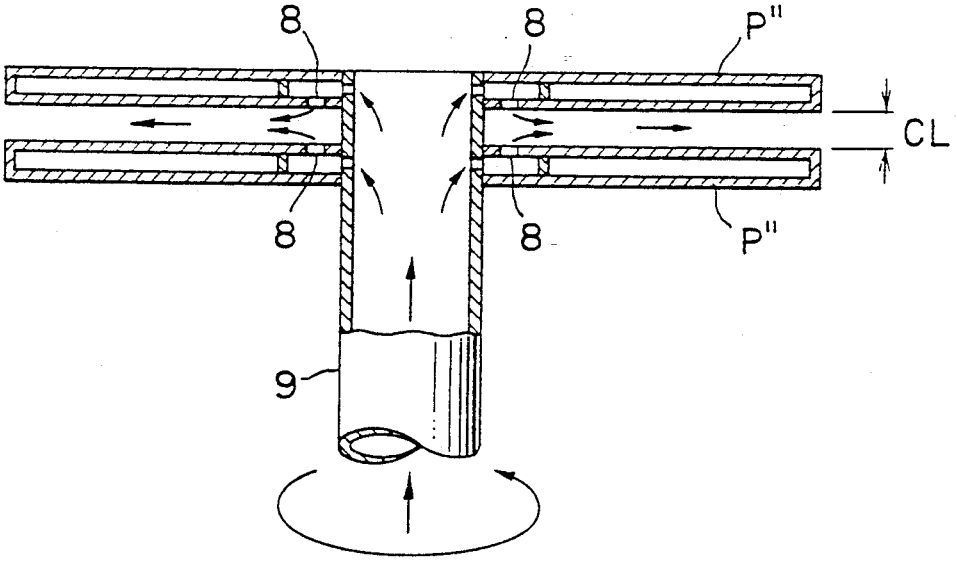

The following experiment was carried out for determining the optimum dimension of the clearance. As shown in FIGS. 6*a* and 6*b*, two annular flat plates P″ having hollow interiors were fixed to a rotational shaft 9 with an adjustable clearance CL therebetween. A plurality of small holes 8 were formed in the vicinity of the inner peripheral edges of the annular plates P″, and the annular plates were rotated around their central axis in the air while delivering, through these holes 8 as shown by arrows, a gas which is sufficiently light in comparison with the air and has corrosiveness with respect to the annular plates P″. The corrosive gas was moved together with the air flow subjected to the centrifugal force due to the annular plates P″ and the loci of the corrosion were observed. In the above experiment, the gas was fed to the holes 8 through the rotational shaft 9 as shown in FIG. 6*b*.

Figure 6C:
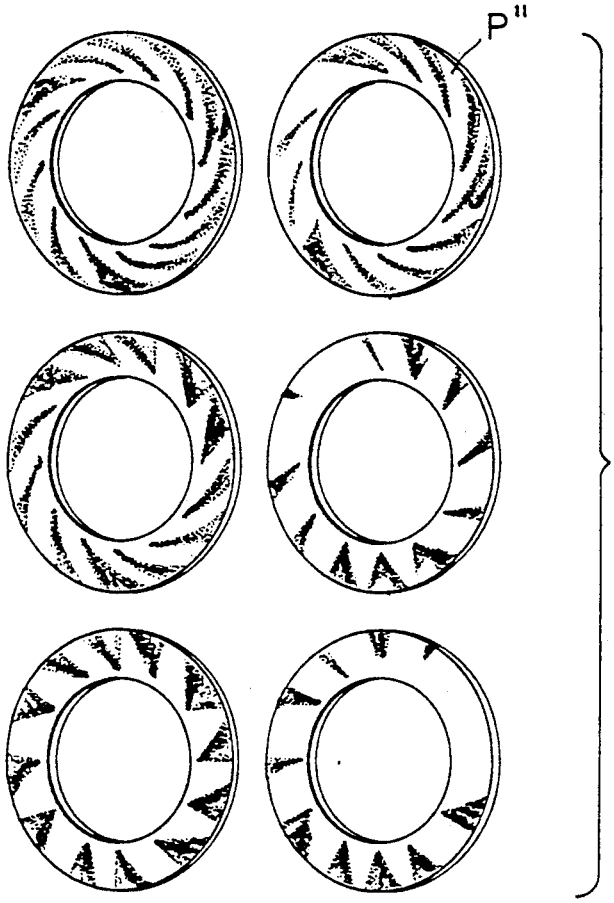
FIG. 6*c* is a perspective view of the plate based on results of the experiment.

According to the observation of the loci of the corrosion, it was found that the gas was caused to flow arcuately in the circumferential direction, as shown by an arrow f, reverse to the rotating direction E of the annular plates P″and that this tendency was increased in of the tendency of the arcuate flow is represented by an angle $\theta$ in FIG. 6*a*. The loci of the gas appeared in the form of light and shade as shown in FIG. 6*c*, and shade portions represent a large quantity of the flow of the gas and the light portions a small quantity of the flow of the gas. The fact that there are many flow loci having large angles $\theta$ means that there are many portions less effected by the adhesion force of the annular plates P″ and hence that the rotational energy of the annular plates P″ is not adequately utilized. On the contrary, the fact that there are many flow loci having small angles $\theta$ means that the adhesion force of the annular plates P″ is strong and the centrifugal force generated is greatly reduced by the adhesion force, thus reducing the flow of the gas.

The following analytical conclusion was obtained by the observation of this arcuate flow phenomenon. An air layer in the clearance of from 0.13 to 0.25 mm between two adjacent annular plates, i.e., an air layer having a thickness of from 0.13/2 to 0.25/2 mm from the surface of each annular plate is considered to be a layer adhering to the surface of the annular plate. This layer is considered to be the air layer a in FIG. 4.

Air in a region beyond the above clearance of 1.0 mm, that is, air spaced apart from the surface of each annular plate by 1.0/2 mm is air that is less influenced by the adhesion force and the centrifugal force due to the annular plate. This air layer is a layer outside the air layer c in FIG. 4. The air in the air layer a is hardly moved even by the centrifugal force because of the strong adhesion force of the annular plate. However, the air layer a is an extremely thin layer, so that the thickness thereof can be substantially disregarded. Furthermore, since air existing outside the air layer c is hardly affected by the operation of the annular plate, it is considered that there must be an area which is readily subjected to the centrifugal force and which has a maximum space efficiency, outside the air layer a but within the air layer c. This area is an area b shown in FIG. 4 and probably ranges from 0.38/2 to 0.5/2 mm, or so, from the surface of the annular plate.

Figure 7:
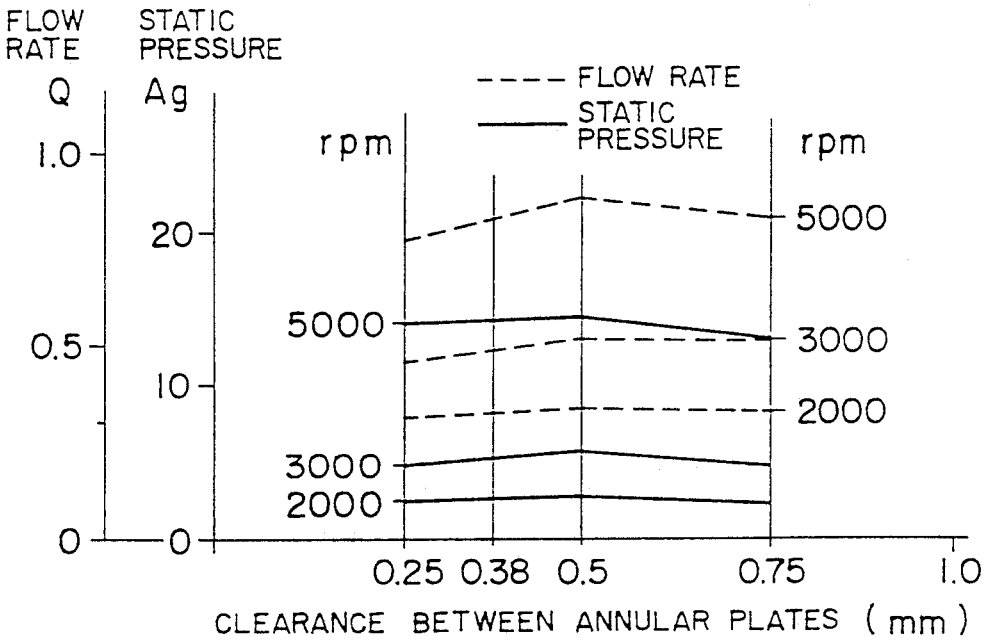
FIG. 7 is a chart of results of the experiment.

The flow rate and static pressure were measured, as shown in FIG. 7, by changing the clearance between the flow generating plates which have an inner diameter of 50 mm and an outer diameter of 74 mm and assembled in parallel with each other with an axial dimension of 21 mm to constitute an air blower. This result corresponds approximately to the aforementioned result of the analysis of the air layer. Accordingly, it was found that a maximum space efficiency can be obtained in a case where the clearance between two adjacent flow generating plates of a flow generating apparatus is about 0.5 mm, i.e. 0.5/2 mm from each of the flow generating plates.

It will be readily noted that, although in the foregoing reference was made to air, an optimum clearance exists with respect to other fluids and the optimum clearance will be obtained by substantially the same procedures as described above with respect to the air.

Accordingly, it is said that the final space efficiency of a flow generating apparatus is determined by the number of the flow generating plates, each of which has a maximum space efficiency per one surface and which are disposed within a predetermined axial length.

As described before, the flow rate Q obtained by the flow generating plate is expressed by $Q=k \cdot R \cdot N$ (R: outer diameter of the flow generating plate, N: rotational speed or number of rotation thereof). Accordingly, in order to increase the flow rate Q, it is necessary to increase the constant k. An embodiment of the invention for increasing the constant k will be described hereunder.

The constant k includes a factor relating to the surface area of the flow generating plate. It is considered that the constant k, and the flow rate Q, is increased by increasing the surface area. When the radii of the inner and outer peripheral edges are limited, the increasing of the surface area can be achieved by making coarse the surface of the flow generating plate, i.e. by forming recesses and protrusions on the surface. This is, however, not a simple matter. As described before, the fluid, that is air, existing within a distance of about 0.5/2 mm from the surface of the flow generating plate is easily moved under a maximum effect of the surface of the flow generating plate. It is therefore considered that the increasing of the surface area at a level spaced from the surface of the flow generating plate by about 0.5/2 mm is most effective. This can be effectively realized by forming on the surface of the flow generating plate waves or ridges having tops directed in radial directions thereof.

Figure 8:
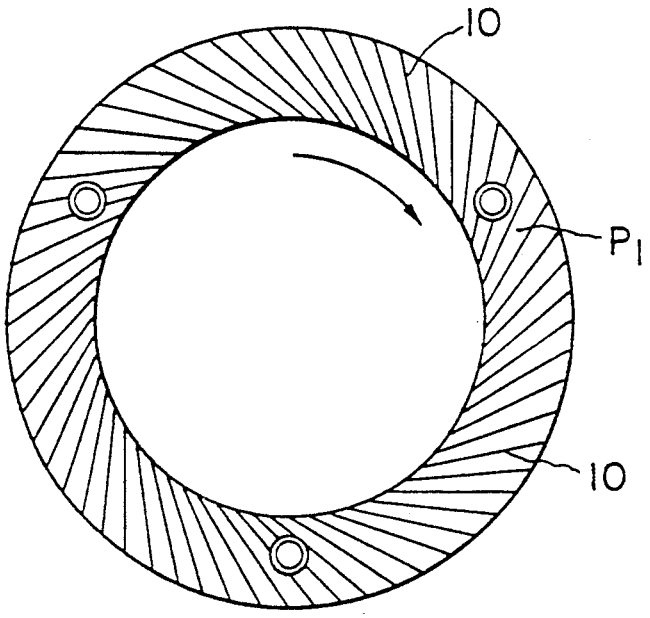
FIG. 8 is a plan view of one example of a flow generating plate provided with a waved surface.
Figure 9:
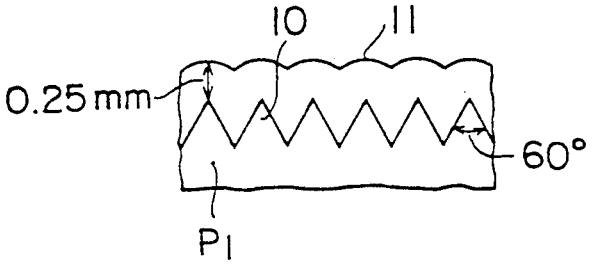
FIGS. 9 and 10 are explanatory diagrams of surface area increase of the flow generating plate.

One example of a flow generating plate having such waves is shown in FIG. 8. Referring to FIG. 8, the flow generating plate $P_1$ has a surface on which is formed waves or ridges 10 inclined with respect to radial lines in directions reverse to the rotation shown by an arrow. The ridges have a regular triangular cross section having an apex angle of 60°. It will be understood that the formation of the regular triangular wave shapes increases twice the surface area of the flow generating plate. However, with reference to an example of FIG. 9 in which small waves each having a regular triangular cross section are formed, the locus 11 of points spaced from the wave surfaces by a distance of 0.5/2 (0.25) mm is an arcuate locus having an extremely low height as shown in FIG. 9. The configuration of the boundary layer area within a range spaced from the flow generating plate by a distance of about 0.25 mm, mentioned hereinbefore, which is most affected by the flow generating plate, is not substantially different from the case of the flow generating plate having a flat surface, so that there is only a slight increase in the constant k.

Figure 10:
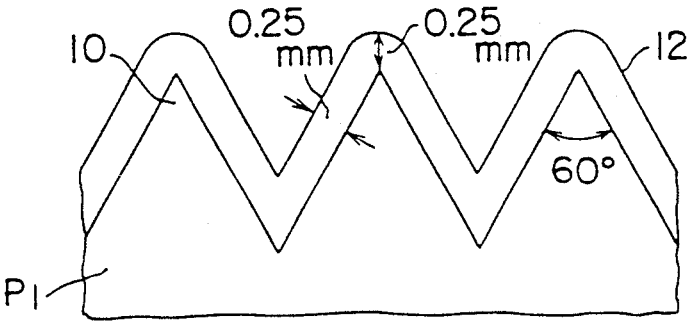

On the contrary, in the case shown in FIG. 10 in which large waves are formed, the configuration of the boundary layer area within the range of 0.25 mm changes considerably as shown at 12 and exhibits a large wave shape compared with 0.25 mm. This is considered to bring about a formation of turbulent flow boundary area, described hereinafter, which increases the thickness of the fluid layer affected by the flow generating plate and hence increases the flow rate of the fluid.

In a case where the sizes of the recesses and protrusions are considerably small in comparison with the value of 0.5/2 mm (0.25 mm), for example, in a case of a crepe or felt-like surface, the formation of the recesses and protrusions are not effective for the increasing of the surface area of the flow generating plate.

Although the flow rate can be increased by forming such a considerably large wave surface on the flow generating plate, this merely applies to one surface of one flow generating plate.

In a theoretical calculation, in a case where flow generating plates having waved surfaces with waves each having a regular triangular cross section are arranged so that the sloping surfaces of adjacent triangular waves confront each other with a clearance of 0.5 mm therebetween in a direction normal to the sloping surface, adjacent flow generating plates face each other with a clearance of 0.5 mm/sin 30°, i.e. 1 mm, in the direction of the rotational axis. In such a case, the axial distance between adjacent flow generating plates becomes twice the distance of 0.5 mm, and accordingly, the number of the flow generating plates that can be arranged within a predetermined axial distance is reduced to half in comparison with a case of arranging flat flow generating plates with planar surfaces. Accordingly, even when the surface area of each of the flow generating plates becomes twice and the flow rate is increased, the increase of the flow rate will be cancelled by the half-reduction of the number of the flow generating plates. This fact applied also to cases other than a case of the wave shape having an apex angle of 60°.

However, results based on such theoretical calculations do not agree with experimental results. According to the experimental results, in fact, the flow rate is increased in the case of a large wave shape.

Experimental results are shown in the following table 1.

TABLE 1

| Experiment No. | I | II | III | IV |
|---|---|---|---|---|
| Flow Generating Plate | Flat Plate | Small wave shape with round apex | Medium wave shape with round apex | Medium wave shape with 60° apex of triangle |
| Outer diameter of flow generating plate (mm) | 74 | 74 | 74 | 74 |
| Inner diameter of flow generating plate (mm) | 50 | 50 | 50 | 50 |
| Entire length of flow generating Plates (mm) | 21 | 21 | 21 | 21 |
| Number of flow generating plates | 30 | 16 | 12 | 9 |
| Clearance between flow generating plates | 0.5 | 0.5 | 1.23 | 1.0 |
| Thickness of spacer | 0.5 | 1.0 | 1.5 | 2.0 |
| Flow rate/Static pressure | | | | |

TABLE 1-continued

| Experiment No. | I | II | III | IV |
|---|---|---|---|---|
| ($m^3$/min) | | | | |
| 2,000 rpm | 0.28/2.2 | 0.33/2.2 | 0.37/2.1 | 0.44/2.6 |
| 2,500 rpm | 0.37/3.4 | 0.41/3.5 | 0.47/3.3 | 0.56/4.1 |
| 3,000 rpm | 0.44/4.9 | 0.5/4.9 | 0.56/4.7 | 0.68/6.2 |
| 5,000 rpm | 0.62/13.4 | 0.7/13.8 | 0.78/13.5 | 0.98/17.4 |

As can be seen from the above table 1, the experimental results are different from the results of the theoretical calculations. Particularly, in cases of the experiments III and IV (medium wave shape), the clearances (values measured in a direction normal to the sloping surface of the wave shape) between adjacent flow generating plates are far different from the optimum value of 0.5 mm and, actually, are 1.23 mm and 1.0 mm. In the case of III, the apex of the wave shape is made round, so that it can be considered that the above-mentioned theory is not applicable, but in the case of IV in which the top of the wave shape constitutes the apex of a regular triangle, the thickness of a spacer is 2.0 mm in the experiment in spite of the theoretical value of 1.0 mm.

This can be considered as result of the presence of a turbulent boundary layer of the fluid. When fluid flows along the surface of a plate, and when the surface of the plate is made coarse so that the coarse surface has a height h throughout the surface of the plate and the plate has a length d along the fluid flow direction, it is known from fluid dynamics that a laminar boundary layer changes into a turbulent boundary layer when the ratio h/d exceeds a certain value. The thickness of the turbulent boundary layer sharply increases in an area in which the flow velocity exceeds a certain value. It is considered, under the conditions of the experiments of the table 1, that the fluid flowing along the surface of the flow generating plate satisfied the above conditions because of the formation of the wave shape, a turbulent boundary layer having a certain degree of adhesion to the flow generating plate and being effectively subjected to centrifugal force was produced, and the thickness of the thus caused turbulent boundary layer exceeded the thickness of the laminar boundary layer generated in a case where a flat flow generating plate is utilized.

Figure 11:
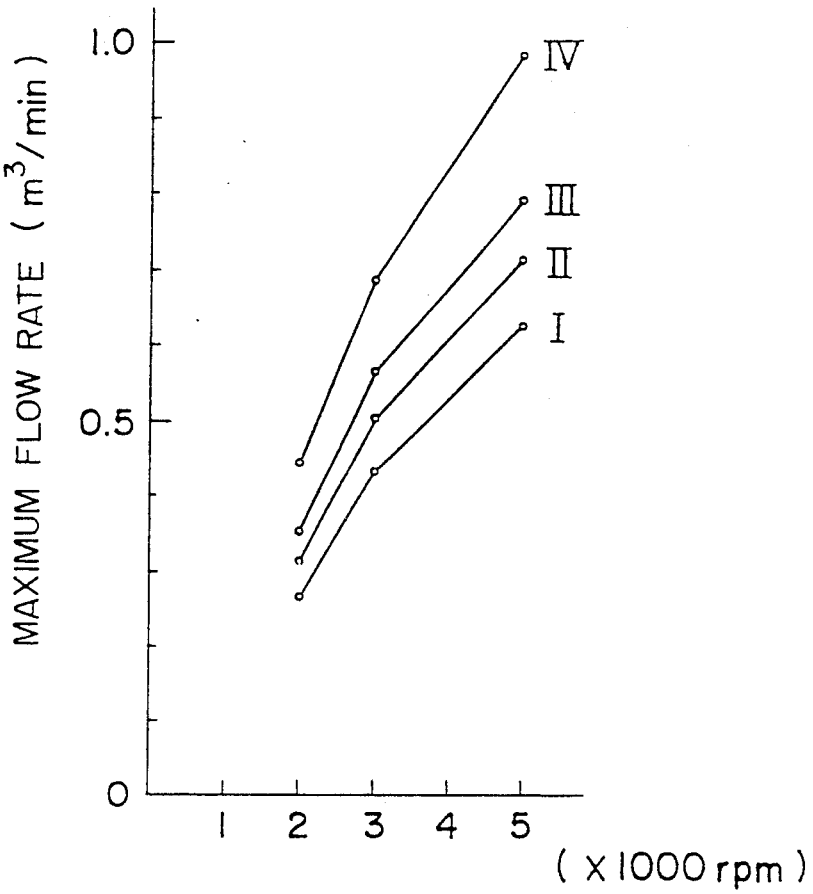
FIG. 11 is a graph indicative of an experimental result regarding the flow rate.

At any rate, it is recognized that the flow rate of the fluid flowing through the clearance between the flow generating plates was increased by the formation of the wave shape on the surface of the flow generating plate. Furthermore, it is also recognized that the increase of the flow rate is remarkable in case of the formation of medium waves in comparison with small waves and that the flow rate and the static pressure are also increased in case of the formation of medium waves each having a triangular apex in comparison with the case of formation of small waves each having a round and irregular apex. The condition of the increase of the flow rate is shown in FIG. 11. As mentioned above, since the formation of the wave shape on the surface of the flow generating plate increases the total flow rate of the fluid and the optimum clearance between adjacent flow generating plates, the total number of the flow generating plates can be reduced, whereby the assembling of them is made easy and the total weight of the flow generating apparatus is reduced.

Figure 12:
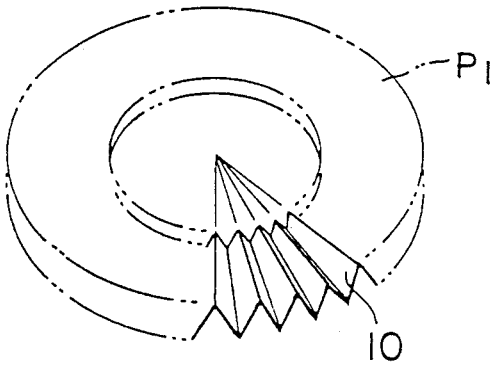
FIG. 12 is a perspective view showing a wave shape of the flow generating plate.

When waves are formed each in a direction having a radial component, as described above, on the flow generating plate $P_1$, as shown in FIG. 12, in which the wave shape 10 is completely directed in radial directions, the triangle at the inner peripheral edge portion of each of the wave shape 10 becomes smaller than that at the outer peripheral edge portion thereof. Accordingly, the clearance in the rotational axis direction between two adjacent flow generating plates $P_1$ is larger at the inner peripheral edge portion than at the outer peripheral edge portion, resulting in an increase of the size of a fluid suction inlet. This means that a limitation on the amount of the fluid flow that can be generated is reduced accordingly.

In the example of FIG. 8, the wave shape extends in the direction reverse to the rotating direction of the flow generating plate. In the example of FIG. 12, the wave shape extends in radial directions. The wave shape may be directed in the rotating direction of the flow generating plate. In any one of these cases, when the flow generating plates are rotated, all the fluid flowing from the inner peripheral edge towards the outer peripheral edge does not necessarily flow along grooves of the wave shapes, but partially flows over the wave shape.

The generation of the flow of the fluid is most influenced by a region in the vicinity of the outer peripheral edge portion of the flow generating plate because the peripheral speed is greatest at the outer peripheral edge portion. Accordingly, it is desirable to arrange the flow generating plate assembly so as to form the most optimum effective clearance in the vicinity of the outer peripheral edge portion of the flow generating plate.

As described above, the formation of the wave shape having radial components on the flow generating plate is significantly desirable for increasing the flow rate. Although, in the foregoing, the increasing of the flow rate has mainly been mentioned, this is because the flow generating apparatus provided with these flow generating plates is conventionally a high-speed and large static-pressure type, and accordingly, it is more important to make an attempt for the increasing the flow rate.

Meanwhile, considering the fact that flow generating apparatuses are often driven by an induction motor, it is highly desired for the flow generating apparatus of this type to generate a large flow at as low of a rotational speed as possible.

The flow generating apparatuses of the present invention of the characters described above generate noise lower than that generated by the conventional apparatus. The flow generating apparatuses of the present invention, however, generate noise due to a fluid cutting or beating operation of the wave shaped region in the outer peripheral edge portion of the flow generating plate. Flow generating apparatuses provided with a device for suppressing the generation of such fluid beating noise are shown in FIGS. 13 through 16.

Figure 13:
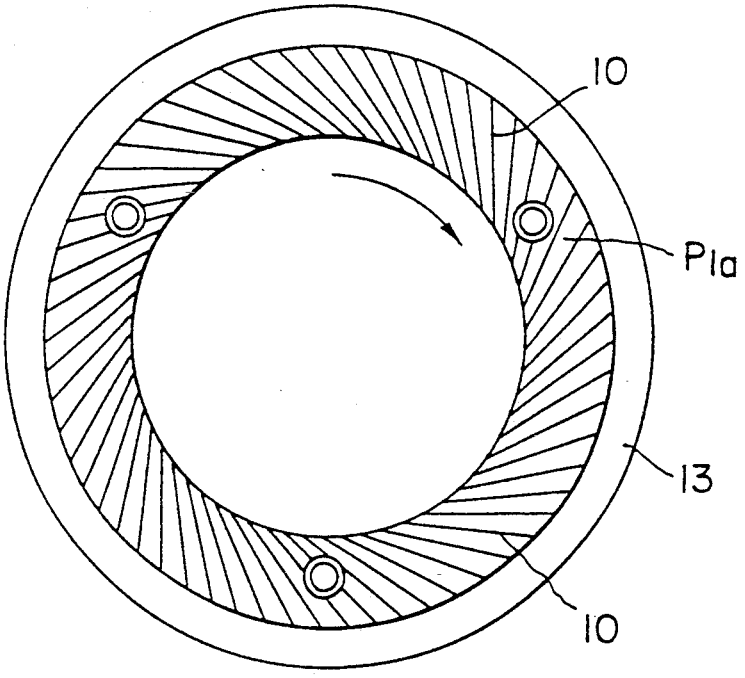
FIG. 13 is a plan view of another example of a flow generating plate.
Figure 14:
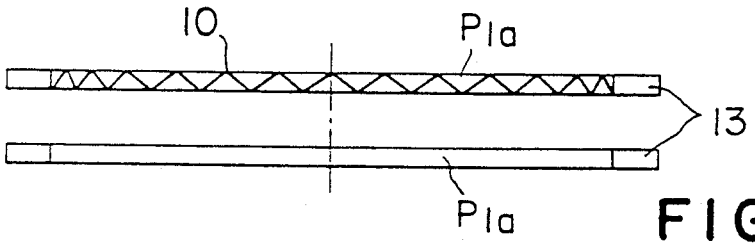
FIG. 14 is a side view of the flow generating plate of FIG. 13.

In the example of FIGS. 13 and 14, each of flow generating plates $P_{1a}$ is formed by integrally forming a flat annular plate-like flow rectifying member 13 with the flow generating plate $P_1$ shown in FIG. 8 along the outer peripheral edge thereof. The flow rectifying plate 13 extends radially outwardly, and turbulent flow of a fluid generated by the radially inward wave shaped portion 10 is rectified while flowing along the flat rectifying plate 13. The fluid flow thus rectified is delivered outwardly without largely disturbing static fluid existing in the external portion of the flow generating plate. The width of the rectifying plate 13 may be determined so as to effectively attenuate changes of the pressure of the turbulent flow, for example, in accordance with the viscosity of the fluid, the shape condition of the waves of the flow generating plate, the clearance between adjacent flow generating plates and so on.

It may be possible to form such an annular plate-like flow rectifying member with the inner peripheral side of the flow generating plate $P_1$.

Figure 15:
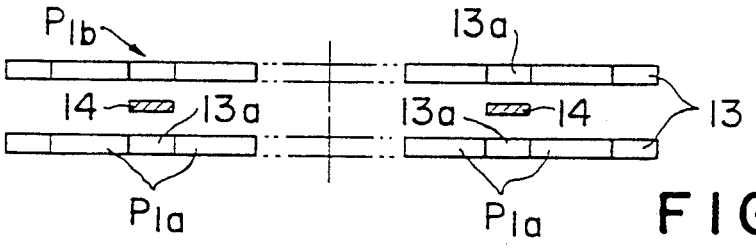
FIG. 15 is a side view of another example of a flow generating plate provided with an auxiliary flow rectifying plate.
Figure 16:
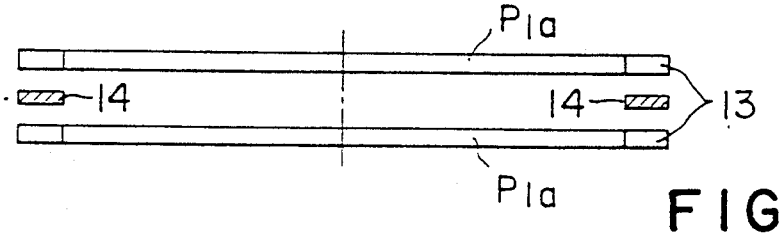
FIG. 16 is a side view of a further example of a flow generating plate provided with an auxiliary flow rectifying plate.

In the example of FIG. 15, a flow generating plate $P_{1b}$ is provided with a further annular plate-like flow rectifying member 13*a* in a radially intermediate portion of the wave shaped portion 10 in addition to the flow rectifying plate 13 formed at the outer peripheral edge of the flow generating plate. In this example, the fluid flow may be rectified intermediate the flow along the wave shape portion of the flow generating plate. It may be possible to further improve the flow rectifying effect by further providing an annular auxiliary flow rectifying plate 14 between the rectifying members 13*a* as shown in FIG. 15 and between the outer peripheral edge portions of two adjacent flow generating plates as shown in FIG. 16.

Figure 17:
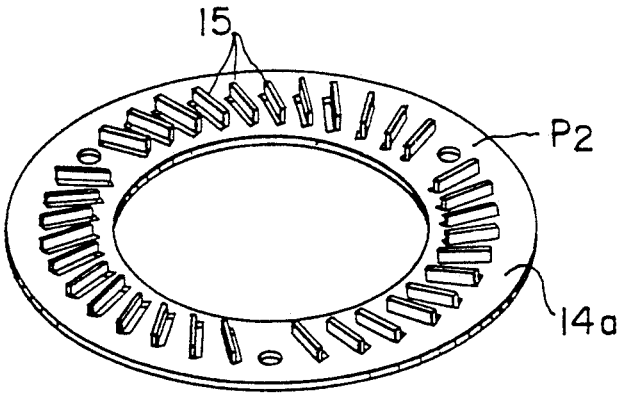
FIG. 17 is a perspective view of another example of a flow generating plate.

FIG. 17 shows an example of a flow generating plate $P_2$ provided with cut and raised upright ribs 15. Each of these upright ribs 15 is formed by forming cut-in portions each having a radial component in the flow generating plate $P_2$ and raising upright the thus cut-in portions. The height of the upright rib 15 is determined so that the constant k of the equation Q (flow rate)$=k \cdot R \cdot N$ becomes largest. A radially outward portion of the flow generating plate $P_2$ is formed as an annular flow rectifying portion 14*a*. The raised upright ribs 15 may serve as spacers.

Figure 18:
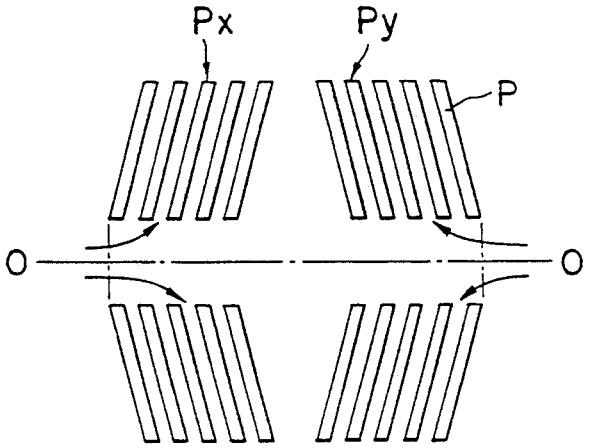
FIGS. 18 through 20 are views showing various shapes and arrangements of the flow generating plates.

The flow generating plates P of the flow generating apparatus may be arranged, as shown in FIG. 18, in a slightly inclined manner with respect to the rotational axis O—O thereof. In this example of FIG. 18, the flow generating apparatus is provided with groups of the flow generating plates $P_x$ and $P_y$ including the plates P inclined in directions adapted for easy introduction of the intake fluid from the lateral sides into a clearance between adjacent flow generating plates.

Figure 19:
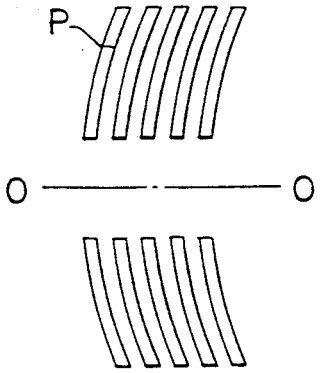
Figure 20:
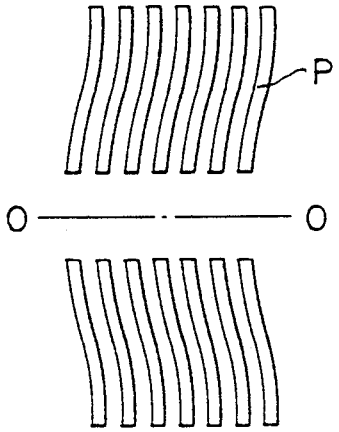

Curved flow generating plates P may be arranged as shown in FIG. 19 in an inclined manner, and as shown in FIG. 20, flow generating plates may be designed so as to have a plurality of surfaces curved in reverse directions, respectively.

Figure 21:
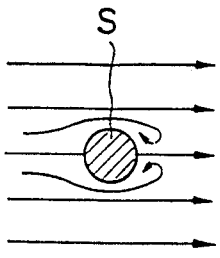
FIGS. 21 and 22 are explanatory diagrams of noise producing phenomena.
Figure 22:
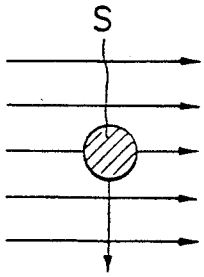
Figure 23:
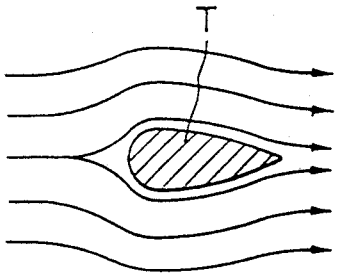
FIG. 23 is a view showing a state where noise is not produced.

The flow generating apparatus of the type in which the flow generating plates are parallelly arranged and rotated has an advantage of generating substantially no fluid cutting noise, which may be caused in a general air blower at a time when blades of the blower cross air flow. However, a fluid cutting noise is still produced by members such as rod members connecting the flow generating plates. The fluid cutting noise is especially produced in a case where, as shown in FIG. 21, a Karman's vortex is generated behind an object S positioned in the flow of fluid such as air, or in a case where, as shown in FIG. 22, an object S is moved across an air flow as shown by an arrow. In the case of FIG. 22, particularly loud noise is generated. With respect to the Karman's vortex, the generation of noise is easily prevented by designing an object T in the air flow so as to have a streamlined outer contour as shown in FIG. 23.

Figure 24:
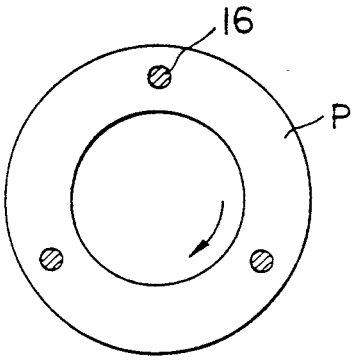
FIG. 24 is an illustration showing a flow generating plate provided with connection members.
Figure 25:
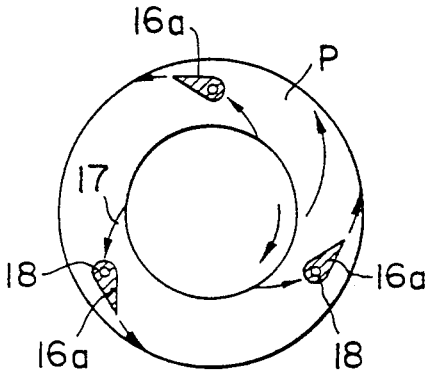
FIG. 25 shows an improved example of the flow generating plate provided with connection members.

In FIG. 24, in which the flow generating plates P are connected by connection rods 16, or other connection means, passing through the plates P, it may seem that such connection rods 16 act on the flow of the fluid passing between the flow generating plates P as shown in FIG. 22 to thereby generate noise. This may be correct with respect to the area B in FIG. 4, i.e. outside the boundary layer because the fluid outside the boundary layer has substantially no relation to the movement of the solid object. On the contrary, in the boundary layer in the area A, the above fact will not apply because the area A is influenced by the movement of the solid object. That is to say, the connection means disposed between the flow generating plates utilizing the boundary layers is one integrated with the solid object and the fluid in the boundary layer movable together with the surface of the solid object, the flow generating plate, (though there exists displacement in the relative motion) and has no relation with the phenomenon shown in FIG. 22. Such connection means, in fact, has the relation shown in FIG. 21. This can be easily prevented. That is, as shown in FIG. 25, this can be prevented by designing the connection rods 16 so as to have a streamlined sectional shape with respect to the locus of the fluid flowing along the surface of the flow generating plate P. According to such design, no Karman's vortex street is generated and the connection rods 16 do not obstruct the flow of the fluid, thus suppressing the generation of noise.

As described above, the utilization of the boundary layer can attain effects in that such a phenomenon as shown in FIG. 22, which is the most remarkable defect in conventional flow generating apparatus such as an air blower and which has no effective countermeasure, can be significantly minimized and, in addition, is replaced by a phenomenon shown in FIG. 21 which can be easily coped with. It is preferred to design the connection rods 16 to be rotatable about pins 18. As mentioned above, since the connection means does not give an adverse influence on the fluid flowing across the connection means, substantially no portion of lowered pressure is produced in the fluid. Such lowered pressure is produced as a result of high pressure generated due to the beating of the fluid. Accordingly, the generation of cavitation as a boiling phenomenon in the low pressure portion can be effectively prevented.

Figure 26:
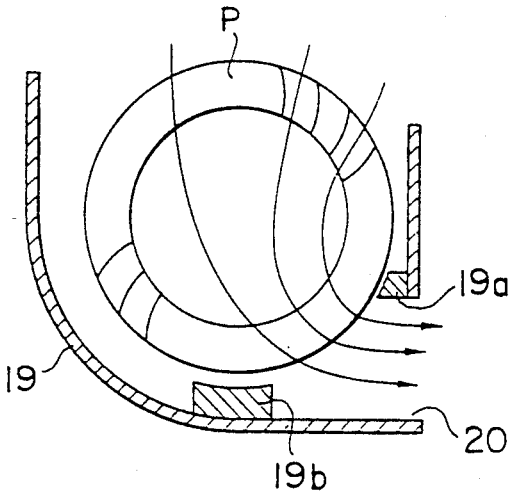
FIG. 26 is an illustration showing an application of the present invention to a cross-flow fan.

In the foregoing embodiments, the flow generating apparatus are of the usual centrifugal type. However, the principle of the flow generating apparatus of the present invention may be applied to a cross-flow fan such as shown in FIG. 26. In FIG. 26, reference numeral 19 denotes a casing, 19*a* a protruding strip, 19*b* a projecting bar which may be formed as occasion demands, and 20 a delivery outlet of the fan.

In the case of a cross-flow fan, as is well known, fluid is aspirated from one lateral side of a columnar type impeller and delivered from an opposite lateral side thereof. For this reason, both the ends of the column are closed. In the conventional cross-flow fan, the impellers cross and beat the flowing fluid at the intake and delivery openings, thus generating the fluid cutting noise twice.

In accordance with the principle of the present invention, such fluid cutting noise may be suppressed by utilizing flat plate-like flow generating plates.

In the case of the cross-flow fan, it is also possible to provide waves such as shown in FIG. 8 and cut-raised ribs such as shown in FIG. 17 to the flow generating plates. In such cases, it is desirable from the view point of the flow rate to form the wave shape so as to be directed reversely to that shown in FIG. 8 (representing a centrifugal flow generating apparatus) with respect to the rotational direction.

In the case of a centrifugal flow generating apparatus, the optimum value of the clearance between the flow generating plates can be determined only in consideration of the discharge of the fluid in the radially outward direction, whereas, in the case of a cross-flow fan, it is necessary to consider the fluid intake condition, and hence, it is necessary to determine the optimum value in view of a balance between the intake and the discharge of the fluid.

In the case of the flow generating plates formed with waves, effective clearances vary depending upon the shape or pitch of the waves. However, it can be said that in the case of flat flow generating plates without recesses and protrusions on the surface, the optimum clearance is about 0.5 mm in the centrifugal type flow generating apparatus, while the optimum clearance is about 1 mm in the cross-flow fan. For example, in a case of a cross-flow fan provided with annular flow generating plates having an outer diameter of 74 mm and an inner diameter of 50 mm, the optimum clearance is 1 mm irrespective of the rotational speed of the flow generating plates. The structures of the flow generating plates shown in FIGS. 14 through 17 may be used also in cross-flow fans.

It was found that the air flow rate is proportional to the peripheral speed of the outer peripheral edge portion of the flow generating plate, that is, the rotational speed.

Figure 28:
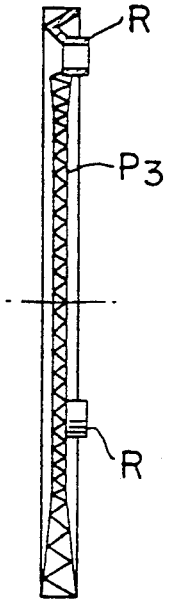
FIG. 28 is a side view of the plate shown in FIG. 27.
Figure 27:
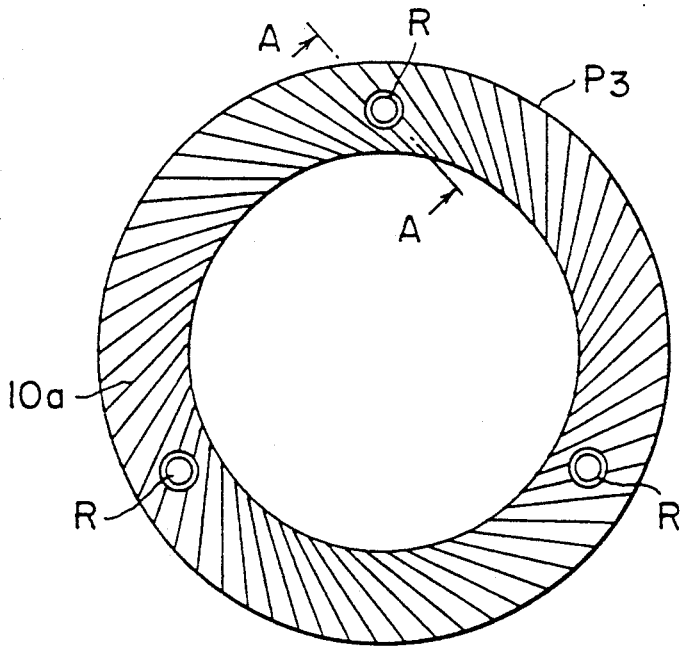
FIG. 27 is a plan view of a further example of a flow generating plate.
Figure 29:
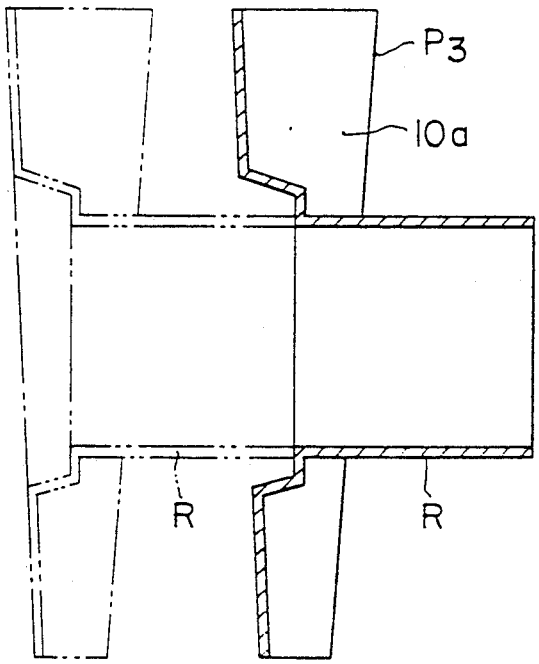
FIG. 29 is a sectional view taken along the line A—A in FIG. 27.
Figure 30:
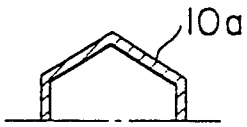
FIGS. 30 and 31 are sectional views of flow generating plates provided with modified wave shapes.

FIGS. 27 through 29 show another example of a flow generating plate $P_3$ that can be used in a cross-flow fan. The flow generating plate $P_3$ has waves 10*a* similar to those of the embodiment shown in FIG. 8 and is integrally provided with protrusions R which serve to connect together adjacent flow generating plates $P_3$ with a constant clearance in the axial direction thereof. In this example, the protrusions R are positioned at equal circumferential distances, and each protrusions R has a cylindrical shape as shown in FIG. 29. In the actual arrangement, these protrusions R are butt-welded as shown in FIG. 29 or connected by means of rods passing through the hollow interiors thereof, both screwed ends of the rods being fastened by nuts, for example, thus enabling an easy assembly of the flow generating plates. The flow generating plates $P_3$ of this type are usable for the usual centrifugal type of flow generating apparatus. It is of course preferable to form each of the protrusions R so as to have a streamlined shape as described hereinbefore.

Figure 31:
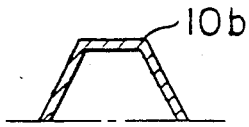
Figure 32:
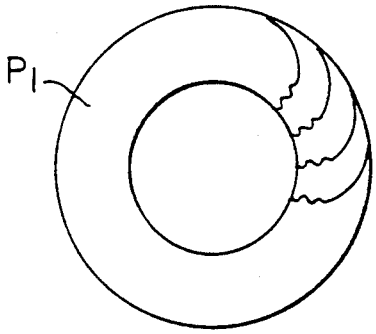
FIG. 32 is a view showing a further example of the wave shape of the flow generating plate.

In the aforementioned embodiment, the top of the wave shape of the flow generating plate is formed so as to have a triangular cross section, but the top may be formed so as to assume a shape corresponding to a half of a hexagonal shape such as shown in FIGS. 31 and 32, or to have a semi-circular shape, sine-curve shape or other polygonal shape.

Furthermore, as shown in FIG. 32, the wave shape may be formed such that a portion near the outer periphery is curved as shown in the aforementioned embodiment and a portion near the inner periphery is of a zigzag shape.

Figure 33:
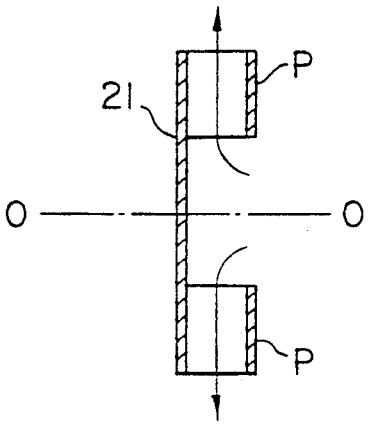
FIGS. 33, 34, 35 and 36 are sectional views of further applications of the flow generating apparatus according to the present invention.
Figure 34:
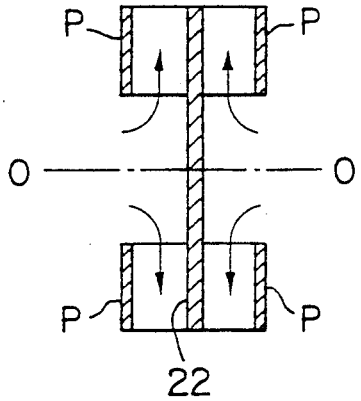
Figure 35:
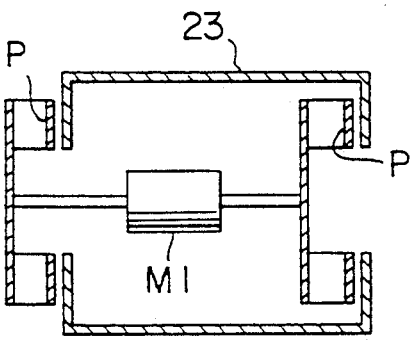
Figure 36:
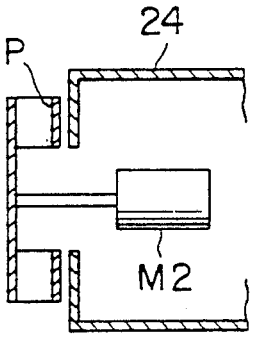

The embodiments described hereinbefore are all related to an air blower, a pump or the like. However, the flow generating apparatus may be utilized as a light shielding mechanism such as shown in FIGS. 33 through 36. In the example of FIG. 33, flow generating plates P are attached to a light shielding wall 21, and this mechanism is rotated about a rotational axis O—O. In this mechanism, air can pass therethrough but light is shielded by the shielding wall 21. In the example of FIG. 34, flow generating plates P are attached to both sides of a light shielding wall 22, and air flow is produced in the direction of the arrows. In the example of FIG. 35, a flow generating apparatus is utilized for shielding light and stifling noise from the inside and outside of a box 23, reference symbol M1 denoting a driving source. In the example of FIG. 36, a flow generating apparatus is utilized for stifling noise from a driving source M2 such as an engine unit in a box 24.

As described hereinbefore, according to the flow generating apparatus of the present invention, noise and cavitation are substantially not generated, and in addition, even if a conventional driving source such as a motor is used, substantially the same flow rate can be obtained within a conventional apparatus by utilizing the flow generating plates with the optimum clearances therebetween. Furthermore, more improved performance can be achieved by forming flow promoting means such as waves on the surface of the flow generating plate. The use of connection means of a specific design can reduce the generation of noise and cavitation to a minimum.

I claim:

1. A flow generating apparatus comprising:

a casing;

a plurality of circular flow generating plates disposed within said casing with clearances established between adjacent ones of said plates, said flow generating plates defining a rotational axis extending perpendicularly to each of the plates, each of said flow generating plates having a major surface for moving a fluid by only adhesion between the surface and the fluid in contact with the surface, said major surface defining waves having tops thereof extending longitudinally in generally radial directions of the plates, and each cross section of a portion of each of the plates taken through each of said waves perpendicular to the top thereof having a triangular shape; and means for rotating the flow generating plates in a direction of rotation about said rotational axis.

2. A flow generating apparatus according to claim 1, wherein each of the tops of the waves extends longitudinally in a radial direction of the plate.

3. A flow generating apparatus according to claim 1, wherein said triangular shape has an apex angle of 60°.

4. A flow generating apparatus according to claim 1, wherein each of said flow generating plates is a thin plate having said waves on two opposite major surfaces thereof.

5. A flow generating apparatus according to claim 1, wherein said clearance is from about 1 to 2 mm.

6. A flow generating apparatus according to claim 1, wherein the apparatus is of a centrifugal type in which said casing has a delivery opening at a location along the outer periphery of said plates, and an intake opening is defined at a location associated with the central portion of said plates, whereby the fluid will pass radially outwardly of the plates and toward the delivery opening.

7. A flow generating apparatus according to claim 1, wherein the apparatus is of a cross-flow type in which said flow generating plates assume a columnar shape having closed axial ends, and said casing defines intake and delivery openings associated with different locations along the periphery of the column of flow generating plates, whereby the fluid will pass from the one of said locations associated with said intake opening to the other of said locations associated with said delivery opening.

8. A flow generating apparatus according to claim 1, and further comprising a member connecting adjacent ones of said flow generating plates, said member having a streamlined shape directed in a main flow direction in which the fluid will flow between the adjacent flow generating plates.

9. A flow generating apparatus according to claim 1, and further comprising a respective annular, flat flow rectifying plate integral with an outer periphery of each of said flow generating plates.

10. A flow generating apparatus according to claim 1, and further comprising a respective annular, flat flow rectifying plate provided in a radially intermediate portion of each of said flow generating plates.

11. A flow generating apparatus according to claim 9, and further comprising an auxiliary flow rectifying plate provided between and spaced from adjacent ones of said flow generating plates in a parallel aligned relation with each respective said flat flow rectifying plate.

12. A flow generating apparatus according to claim 10, and further comprising an auxiliary flow rectifying plate provided between and spaced from adjacent ones of said flow generating plates in a parallel aligned relation with each respective said flat flow rectifying plate.

13. A flow generating apparatus comprising:

a casing;

a plurality of circular flow generating plates disposed within said casing with clearances established between adjacent ones of said plates, said flow generating plates defining a rotational axis extending perpendicularly to each of the plates, each of said flow generating plates having a major surface for moving a fluid by only adhesion between the surface and the fluid in contact with the surface, said major surface defining waves, each of the tops of the waves extending longitudinally from a radially inward portion of the plate in a direction reverse to the direction of rotation of the plate at an angle relative to a radial direction of the plate extending through said inward portion; and means for rotating the flow generating plates in a direction of rotation about said rotational axis.

* * * * *